US007025220B2

(12) United States Patent
Verespej et al.

(10) Patent No.: US 7,025,220 B2
(45) Date of Patent: Apr. 11, 2006

(54) FITMENT AND PACKAGE FOR STORING FLUID-CONTAINING MATERIALS AND METHODS FOR THEIR PRODUCTION

(75) Inventors: Rocklin Verespej, San Clemente, CA (US); Luke Hartman, Garden Grove, CA (US); Simon Edwards, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/337,437

(22) Filed: Jan. 6, 2003

(65) Prior Publication Data

US 2003/0159403 A1 Aug. 28, 2003

Related U.S. Application Data

(60) Provisional application No. 60/346,030, filed on Jan. 4, 2002.

(51) Int. Cl.
*B65D 43/18* (2006.01)

(52) U.S. Cl. ..... 220/259.1; 206/233

(58) Field of Classification Search ..... 220/259.1, 220/255.1, 258.3, 254.6, 265, 266, 258.1, 220/492; 215/901; 211/62, 63, 45, 53; 222/541.6, 222/241.4; 206/611, 233
See application file for complete search history.

(56) References Cited

U.S. PATENT DOCUMENTS 3,883,034 A * 5/1975 Rausing ..... 220/268
4,126,263 A * 11/1978 Martensson ..... 229/229
4,185,754 A 1/1980 Julius
4,231,486 A * 11/1980 Bock ..... 220/266
4,258,876 A * 3/1981 Ljungcrantz ..... 229/125.14
4,576,306 A * 3/1986 Kelsey et al. ..... 220/271
4,699,290 A * 10/1987 Adams ..... 220/258.2
4,887,735 A * 12/1989 Dudzik ..... 220/789
5,271,519 A * 12/1993 Adams et al. ..... 220/375
5,348,183 A * 9/1994 Luch et al. ..... 220/265
5,484,101 A * 1/1996 Hedberg ..... 229/125.04
5,501,323 A 3/1996 Denesha et al.
5,699,912 A * 12/1997 Ishikawa et al. ..... 206/494
5,729,955 A * 3/1998 Yamada ..... 53/412
5,875,918 A * 3/1999 Sheffler et al. ..... 220/783
6,065,626 A * 5/2000 Huang et al. ..... 220/254.5
6,079,618 A * 6/2000 Hedberg et al. ..... 229/125.15
D446,452 S 8/2001 Buck et al.
6,554,156 B1 * 4/2003 Chong ..... 221/63
6,845,902 B1 * 1/2005 Bomer et al. ..... 229/125.09
2002/0017522 A1 * 2/2002 Bando et al.
2004/0124200 A1 * 7/2004 Yuhara

FOREIGN PATENT DOCUMENTS

JP 9-2548 1/1997
JP 9-226861 9/1997

* cited by examiner

*Primary Examiner*—Lien M. Ngo
(74) *Attorney, Agent, or Firm*—Watson IP Group, PLC; Jovan N. Jovanovic

(57) ABSTRACT

A hermetic package having a fitment having base coupled to a lid. The base is composed of a collar having a recessed groove, the base of the fitment defines an opening which provides access to the contents of the hermetic package. The lid is a planar structure having a first face and a second face. The lid includes a sealing member extending from the second face of the lid and engages the recessed groove on the base of the fitment to provide an airtight seal.

10 Claims, 9 Drawing Sheets

FIG. 4
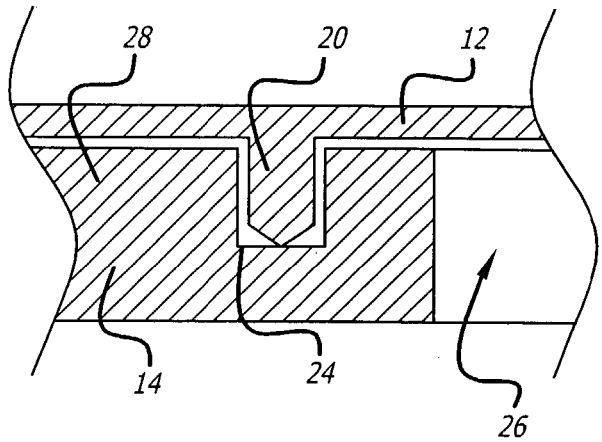
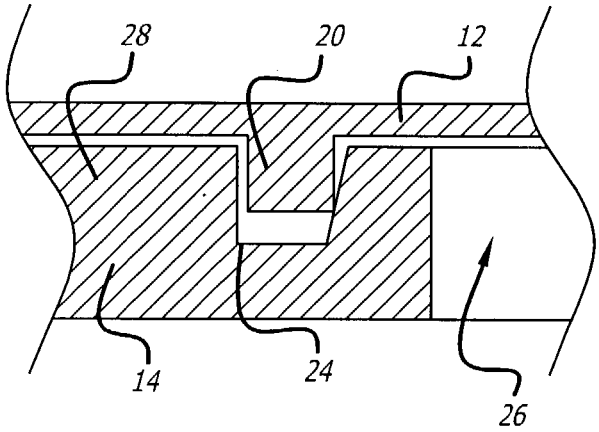
FIG. 5
FIG. 5A
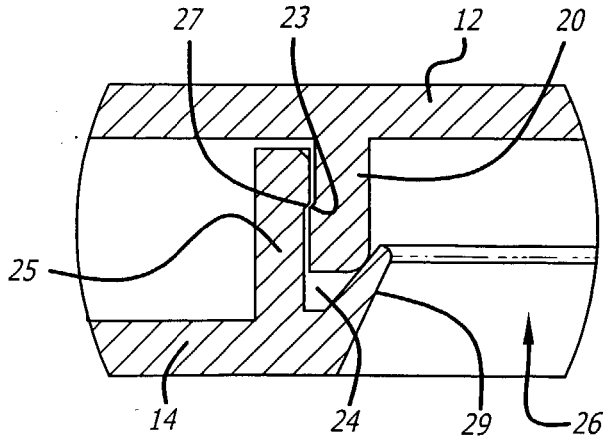

FIG. 8
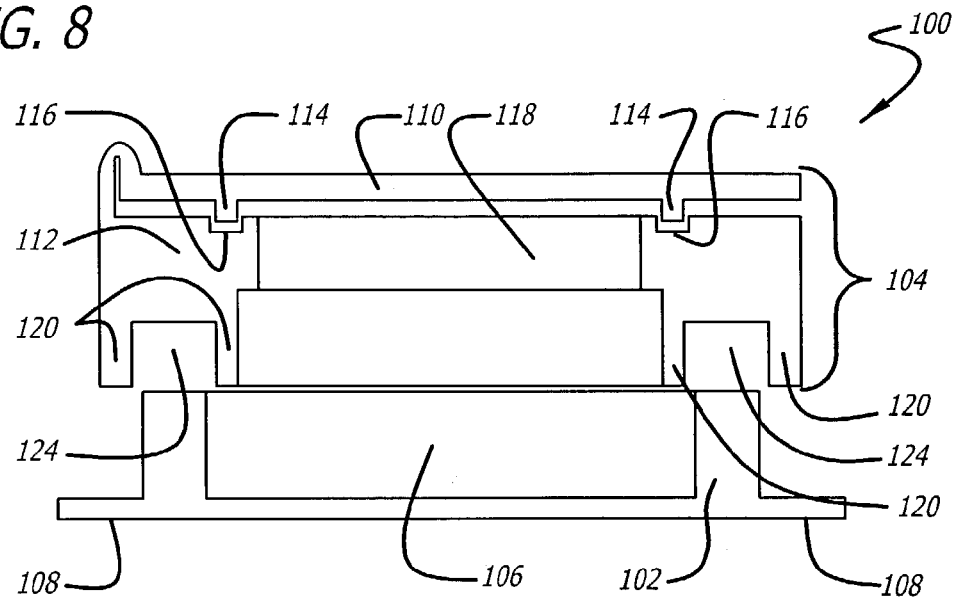
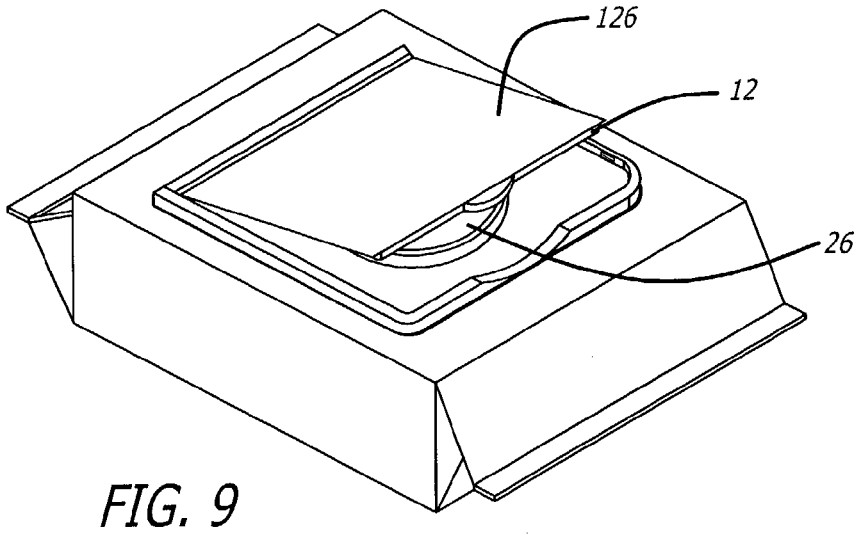
FIG. 9

FITMENT AND PACKAGE FOR STORING FLUID-CONTAINING MATERIALS AND METHODS FOR THEIR PRODUCTION

CROSS REFERENCE TO RELATED APPLICATIONS

This application claims the benefit of U.S. Provisional Patent Application No. 60/346,030, filed Jan. 4, 2002, and whose entire contents are hereby incorporated by reference.

BACKGROUND

Fluid-containing wipes, towelettes, sheets, tissues have gained commercial success in both business and domestic markets. These fluid-containing sheets of material are impregnated or substantially saturated with solutions or chemicals that may be used for personal hygiene, cosmetic purposes, and cleaning purposes. Generally, these fluid-containing sheets are stored in various moisture-impermeable packages such as bags, semi-rigid containers, or rigid containers. Typically, these packages have resealable openings that permit an individual to remove a fluid-filled sheet from the package and a hinged lid or cap to seal the opening or port. However, these prior art resealable openings do not provide a hermetic seal after the package is initially opened. Accordingly, any fluid-containing products may dry out over time once the package has been opened.

Additionally, prior art resealable openings may also include detachable tamper-evident foil seals or plugs that seal the opening. These tamper-evident foil seals provide a dual function. First, these foil seals act as a barrier to prevent inadvertent opening of the package. Also, these tamper-evident seals act as a barrier that maintains the moisture content of the fluid-containing sheets. That is, the tamper-evident seals maintain an airtight (hermetic) structure in order to maintain an extended shelf-life of the product such as fluid-containing sheets.

When prior art packages are first opened, the tamper-evident seal is removed and/or detached from the resealable opening to access the fluid-containing sheets. Thereafter, the hinged lid or cap is used to seal the package opening. Because the tamper-evident seal has been removed, the package is no longer airtight. While prior art packages that store fluid-containing sheets have been useful, improved resealable closures are desired that provide a hermetic package after the package has been opened.

SUMMARY

Embodiments of the fitments described herein can be adapted for use in a variety of packages such as, but not limited to, flexible bags, flexible bags used in bag-in-box packages, semi-rigid containers, and rigid containers. According to the various exemplary embodiments, the fitments provide an airtight or hermetic seal so as to minimize evaporation of the fluids that may be contained within package. More specifically, the fitments may used in packages that are adapted to store fluid-containing sheets, wipes, tissues, and cloths. The fitments disclosed herein are airtight prior to and after initial opening of the package. That is, the fitments are provided with sealing members that are capable of providing an airtight seal each time the fitment is closed.

According to one exemplary embodiment, the fitment is composed of a base and a lid. The base has a collar that defines an opening, and the base also includes a recessed groove. A lid, having a first face and a second face, is coupled to the base. The lid also includes a sealing member that extends from the second face of the lid, and the sealing member is capable of engaging the recessed groove on the base to provide an airtight seal. In another exemplary embodiment, the fitment may include a non-detachable tamper-evident material applied over the opening of the fitment. In yet another embodiment, the fitment may include a baffle composed of overlapping flaps.

In another exemplary embodiment, the fitment is composed of a cap and a lid. The cap has a lid having a first face and a second face, wherein the second face includes a sealing member extending from the surface of the lid. The lid is coupled to a base that has a collar that defines an access port. The collar also includes a recessed groove where the sealing member is capable of engaging the recessed groove to provide an airtight seal when the lid is closed over the base. The cap is attachable to the first end of a body. The body is a walled structure having an opening. The body also has a flange that extends from the outer surface of the body which allows the body to be attached to a package. In another exemplary embodiment, the fitment may include a non-detachable tamper-evident material applied over the opening of the fitment. In yet another embodiment, the fitment may include a baffle composed of overlapping flaps.

According to the exemplary fitment embodiments, the sealing member on the lid of the fitment and/or the recessed groove on the base of the fitment may be sized and shaped to form a hermetic seal between the sealing member and the recessed groove. In one exemplary embodiment, the sealing member is tapered thereby forming an interference fit with the walls of the recessed groove. In another exemplary embodiment, at least one of the walls of the recessed groove are tapered to form an interference fit with the sealing member. In yet another exemplary embodiment, the sealing member may be a curved structure having a concave and convex face.

A hermetic package having a fitment, as described above, may be manufactured by according to various methods. According to one exemplary method, a portion of a roll of material is unwound. A hole is punched through the unwound portion. A fitment may then be secured within the hole. A stack of dry tissue may be placed on the unwound portion and the fitment. The unwound portion is then formed into pouch that encompasses the dry stack of tissue. A fluid may then be applied to the dry stack of tissue by dispensing the fluid through the fitment onto the tissue. A resealable lid is then secured onto the fitment to form a hermetic package.

BRIEF DESCRIPTION OF THE DRAWINGS

FIG. 4 is a cross-sectional view of yet another exemplary embodiment of a fitment in a closed state;

FIG. 5 is a cross-sectional view of another exemplary embodiment of a fitment in a closed state;

FIG. 5A is a cross-sectional view of yet another exemplary embodiment of a fitment in a closed state;

FIG. 8 is an exploded cross-sectional view of another exemplary embodiment of a fitment in a closed state;

FIG. 9 is a perspective view of an exemplary fitment embodiment having a tamper-evident seal placed over the fitment;

DETAILED DESCRIPTION

Embodiments of the fitments described herein can be adapted for use in a wide variety of packages. For example, the fitments may be attached to flexible bags, flexible bags used in bag-in-box packages, semi-rigid containers, rigid containers, and the like. More specifically, the fitments may be used in packages to store fluid-containing materials such as, but not limited to, wipes, tissues, and cloths. As those skilled in the art will appreciate, the fitments described herein may be adapted for use in containers that holds a substantial amount of fluids. According to the various exemplary embodiments, the fitments provide an airtight or hermetic seal so as to prevent evaporation of the fluids from the package. More specifically, the fitments are airtight prior to and after initial opening of the package. That is, the fitments are provided with sealing members that are capable of providing an airtight seal each time the fitment is closed.

Figure 1:
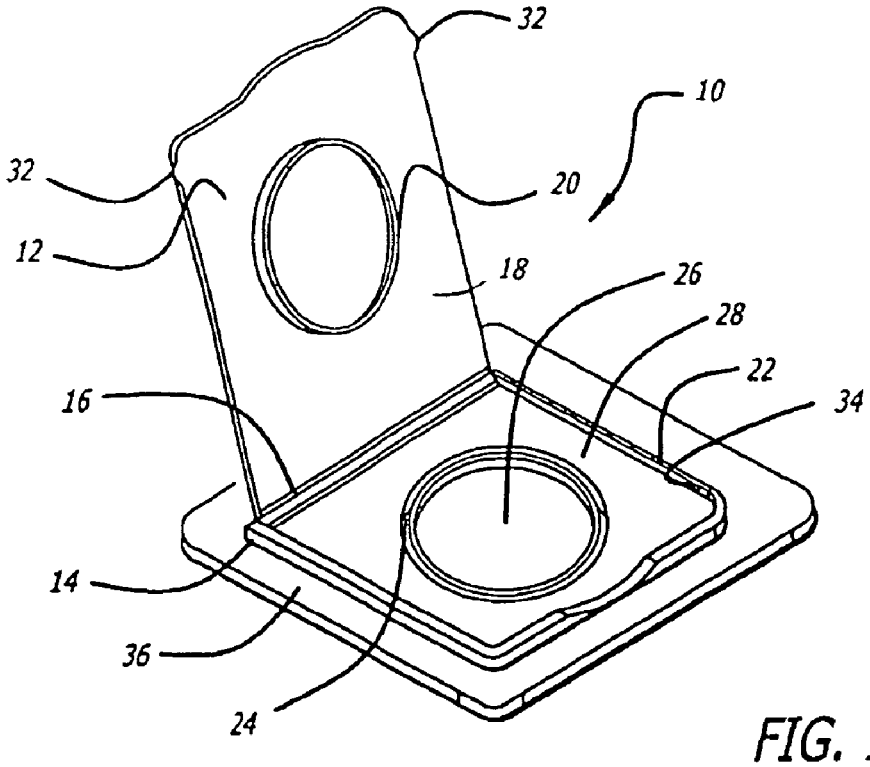
FIG. 1 is a perspective view of an exemplary embodiment of a fitment in an open state.

FIG. 1 illustrates one exemplary embodiment of a fitment 10. The fitment 10 includes a lid 12 coupled to a base 14. As shown in FIG. 1, the lid 12 is coupled to the base 14 by a hinge 16. In another exemplary embodiment, one or more hinges may be used to couple the lid to the base. The lid is a generally planar structure having a first face (not shown) and a second face 18. The second face 18 includes a sealing member 20 that protrudes from the second face 18 of the lid 12. The sealing member 20 is a wall that defines a shape that corresponds to a recessed groove 24 on the base 14 of the fitment 10. As shown in FIG. 1, the walls of the sealing member 20 form a generally circular shape According to alternate embodiments, the sealing member 20 may be shaped as an ellipse, oval, square, rectangle, triangle, pentagon, hexagon, octagon, or any other shapes.

Figure 2:
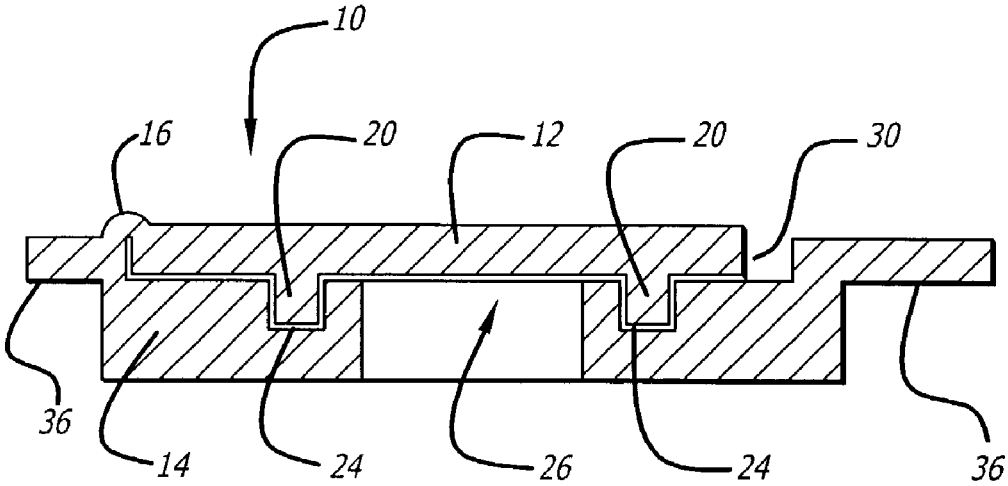
FIG. 2 is a cross-sectional view of an exemplary embodiment of a fitment in a closed state.

The base 14 of the fitment is composed of a collar 22 having a recessed groove 24. The recessed groove 24 is sized to receive the sealing member 20 on the lid. The collar 22 may also include an opening 26 and a shoulder 28 about the perimeter of the base 14. The shoulder 28 is recessed and contacts the second face 18 of the lid when the lid is closed over the base 14. The shoulder 28 may be sized and shaped to form a substantially flush surface when the lid 12 is closed over the base 14. As shown in FIG. 2, the base 14 includes a recess 30 that is sized to allow an individual to open the lid by inserting the individual's fingers within the recess 30 to catch the edge of the lid 12.

As shown in FIG. 1, the base also includes a flange 36 that extends from the outer perimeter of the base. According to one exemplary embodiment, the flange extends from the lower portion of the base as shown in FIG. 1. In another exemplary embodiment, the flange may extend from the upper portion of the base. By providing the flange at the upper portion of the base, the fitment 10 may be substantially flush with the surface of the package (not shown). As those skilled in the art will appreciate, the flange 36 may be positioned anywhere on the outer surface of the base 14.

The flange is a generally planar structure that provides a surface to secure the base 14 of the fitment to a wall of the package (not shown). The flange may be secured to the wall of the package by any means known or developed in the art. For example, the walls of the package may be secured to the flange by such methods including, but not limited to, heat sealing or induction sealing. Alternatively, adhesives may be used to secure the flange to the walls of the package. According to one exemplary embodiment, the bottom surface of the flange 36 is secured to the outer surface of the package wall (not shown). In yet another embodiment, the upper surface of the flange 36 is secured to the inner surface of the package wall (not shown).

In another exemplary embodiment of the fitment, the lid 12 may be provided within a recessed groove and the sealing member extends from the face of the base 14. In yet another embodiment, the fitment may include a projection 32 on the lid that mates with a recess 34 on the base of the fitment. When the projection 32 engages the recess 34 on the base 14, an audible click signals the user that the sealing member 20 has sealingly engaged to the recessed groove 24 on the base 14 of the fitment 10. Alternatively, as those skilled in the art will appreciate, the projection may be provided on the periphery of the shoulder and the recess is positioned on the lid.

Figure 1A:
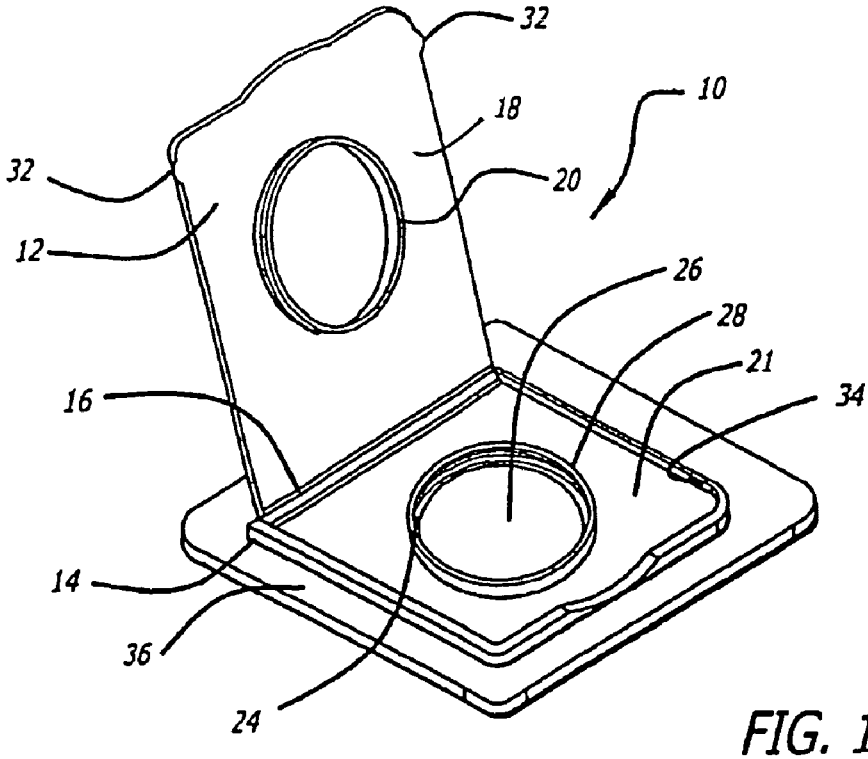
FIG. 1A is a a perspective view of another exemplary embodiment of a fitment in an open state.

FIG. 1A illustrates another exemplary embodiment of a fitment 10. The fitment depicted in FIG. 1A is similar to the fitment of FIG. 1 with the exception of the positioning of the recessed groove 24. As shown in FIG. 1A, the shoulder 28 extends from the floor 21 of the base 14, and the recessed groove 24 is provided between the walls of the shoulder 28. Accordingly, the recessed groove 24 is level with the floor of the base 14. In contrast, the recessed groove 24, as shown in FIG. 1, is positioned below the surface of the shoulder 28.

Figure 3:
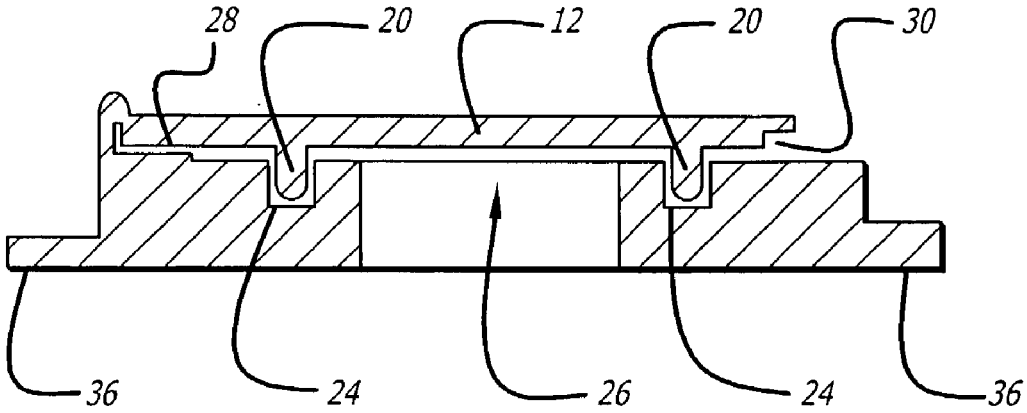
FIG. 3 is a cross-sectional view of another exemplary embodiment of a fitment in a closed state.

FIG. 2 is a cross-sectional view illustrating the sealing member 20 of the lid 12 engaged with the base 14 of the fitment 10 to from an airtight seal. As shown in FIG. 2, the walls of the sealing member 20 are substantially parallel with a substantially flat base. In another exemplary embodiment, the base of the sealing member may be curved as shown in FIG. 3. In yet another exemplary embodiment, the base of the sealing member may taper to a point as shown in FIG. 4. As shown in FIGS. 2–4, the walls of the recessed groove 24 are substantially parallel and include a substantially flat base. In another exemplary embodiment, the base of the recess groove 24 may be a concave or convex curve. When the lid 12 is closed over the opening 26 of the base 14 of the fitment 10, the walls of the sealing member 20 and the base of the sealing member engage the walls and the base of the recessed groove 24 on the collar 22 to form an airtight seal. Each position at which the walls and base of the sealing member engage the corresponding walls and base of the recessed groove are sealing points that provide a seal between the lid and the base of the fitment.

FIG. 5 illustrates another exemplary embodiment of the sealing member 20 engaging the walls of the recessed groove 24. As shown in FIG. 5, one wall of the recessed groove 24 is substantially perpendicular to the base of the recessed groove 24. The opposite wall of the recessed groove is angled with respect to the base of the recessed groove. In another exemplary embodiment, the walls of the sealing member may be angled and the walls of the recessed groove are substantially parallel to one another. In yet another exemplary embodiment, both the walls of the sealing member and the walls of the recessed groove may be angled. The walls of the sealing member are substantially parallel and include a curved base. In another exemplary embodiment, the base of the sealing member may be substantially flat. In yet another exemplary embodiment, the base of the sealing member may be tapered. In these various exemplary embodiments, when the lid is closed, the walls and/or base of the sealing members may engage the walls and/or base of the recessed groove in an interference fit to form an airtight seal.

FIG. 5A illustrate yet another exemplary embodiment of the sealing member 20 engaging the walls of the recessed groove 24. Like previous embodiments, the sealing member 20 extends from the surface of the lid 12, and the walls of the sealing member 20 are substantially parallel. As shown in FIG. 5A, the outer wall of the sealing member 20 includes an undercut 23. By providing an undercut 23, the end of the sealing member 20 has a larger circumference than the body of the sealing member. Additionally, the corners of the sealing member may be radiused. As shown in FIG. 5D, one corner of the sealing member is radiused.

FIG. 5A also illustrates an exemplary embodiment of a recessed groove 24 adapted to engage the sealing member 20. As shown in FIG. 5A, the recessed groove has a first wall 25 extending from the base 14 of the fitment. The first wall 25 may also include an undercut 27. Additionally, the recessed groove includes an angled wall 29 that protrudes from the base of the fitment. As shown in FIG. 5A, the angled wall 29 is tapered, but alternate embodiments of the angled wall may be of uniform width. The angled wall 29 permits the formation of an airtight seal with minimal pressure. That is, the angled wall 29 can yield or flex when contacted by the sealing member 20. In contrast, seals of prior art fitments are formed by an interference fit between rigid surfaces. Consequently, large amounts of force may be required to form a seal as the rigid surfaces are wedged against one another. Over time, the large amounts of force required to form a seal between rigid surfaces may also result in the permanent deformation of the rigid surfaces. As a result, these seals in prior art fitments may not be airtight.

In use, the undercut 27 of the recessed groove 24 and the undercut 23 of the sealing member 20 may engage one another when the lid 12 is closed. That is, audible click or snap fit is perceived by the user to signal that the sealing member 20 has sealingly engaged the angled wall 29 of the recessed groove 24 to form a hermetic seal.

Figure 6:
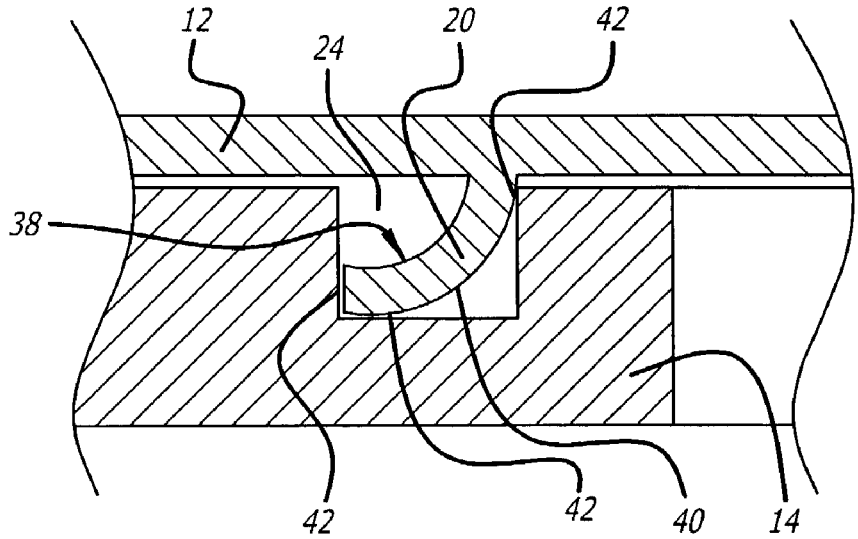
FIG. 6 is a cross-sectional view of another exemplary embodiment of a fitment in a closed state.

FIG. 6 illustrates another exemplary embodiment of the sealing member 20 engaging the walls of the recessed groove 24. As shown in FIG. 6, the sealing member 20 is a generally curved structure having a concave face 38 and a convex face 40. The width of the sealing member 20 is substantially uniform along the length of the sealing member 20. The convex face 40 of the sealing member 20 contacts the surfaces of the recessed groove 24 to form at least one seal 42. Because there are many sites of contact between the sealing member 20 and the recessed groove 24, the lid 12 is hermetically sealed when closed which limits the evaporation or out-gassing of fluids from a package. Additionally, as shown in FIG. 6, the lid also may include at least one protuberance (not shown) that engages at least one recess (not shown) on the shoulder of the base. As described above, when the protuberance engages the recess, audible click or snap is emitted thereby signaling the user that the sealing member has sealingly engaged the walls of the recessed groove to form a hermetic seal.

Figure 7:
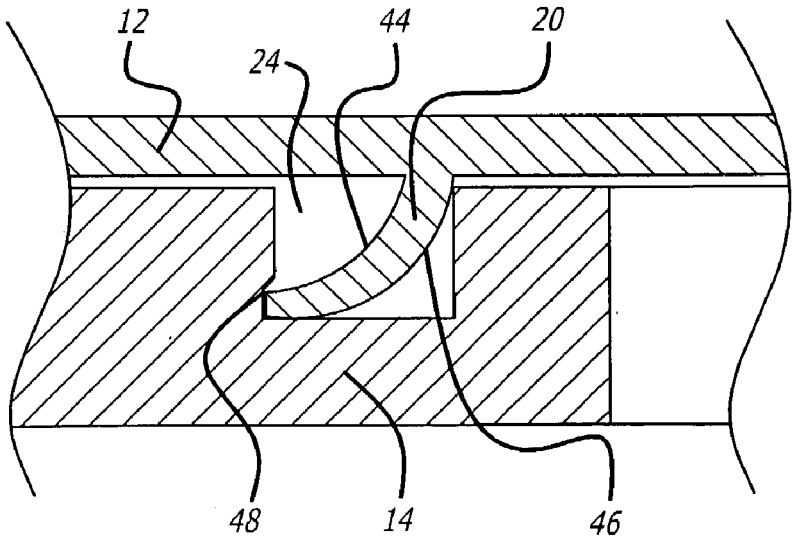
FIG. 7 is a cross-sectional view of another exemplary embodiment of a fitment in a closed state.

FIG. 7 illustrates yet another exemplary embodiment of the sealing member 20' engaging the walls of the recessed groove 24. The sealing member 20' depicted in FIG. 7 is similar to the sealing member 20 of FIG. 6 with the exception that the sealing member 20' is tapered. The convex face of the sealing member contacts the surfaces of the recessed groove to form at least one seal. By providing a tapered sealing member 20', the sealing member 20' is resilient thereby allowing for greater contact are between the sealing member 20' and the walls recessed groove 24. Additionally, as shown in FIG. 8, an indentation 48 may be provided on the wall of the recessed groove 24 to catch the end of the sealing member 20'.

In another exemplary embodiment, the recessed groove 24 may not be provided with an indentation. Rather, as described above, the lid 12 may be provided with at least one protuberance 32 that engages at least one recess 34 on the shoulder 28 of the base 14. According to various exemplary embodiments, a locking means, such as the protuberance-recess interface or sealing member-indentation interface, ensures that the lid 12 sealingly engages the base 14 of the fitment as the tapered sealing member 20' may have spring-like qualities when compressed. In other exemplary embodiments, the interference fit between the tapered sealing member 20' and the recessed groove 24 may be sufficient to hermetically seal the lid 12 to the base 14 of the fitment.

FIG. 8 illustrates another exemplary embodiment of a resealable fitment 100 capable of forming an airtight seal. The fitment 100 is a two-piece structure composed of a spout body 102 and a cap 104. The spout body 102 has a wall that defines an opening 106. As those skilled in the art will appreciate, the opening 106 may be sized and/or shaped for any desired application. The spout body 102 also includes a flange 108 that extends away from the outer perimeter of the spout body. As discussed above, the flange 108 may be positioned anywhere along the length of the spout body 102.

As shown in FIG. 8, the cap 104 includes a lid 110 hinged to a cap body 112. The lid 110 is a generally planar structure having a sealing member 114 extending from the surface of the lid 110. The sealing member 114 may have a plurality of configurations as illustrated in FIGS. 2–7. The cap body 112 includes a recessed groove 116 sized to sealingly engage the sealing member 114 of the lid 110. The cap body 112 also includes an opening 118 positioned between the recessed groove 116. A plurality of flanges 120 extend from the base of the cap body 112. The space 124 between adjacent flanges 120 is sized to engage the spout body 102. According to one exemplary embodiment, the cap may be snap-fitted onto the spout body. In another exemplary embodiment, the cap may be coupled to the spout body by adhesives. In yet another exemplary embodiment, the cap may be welded or otherwise affixed to the spout body.

FIG. 9 illustrates one exemplary fitment embodiment having a non-detachable tamper-evident seal 126 applied to the top of the lid 12 of the fitment 10. Additionally, the tamper-evident seal 126 may be scribed to facilitate the initial opening of the package. A small portion of the tamper-evident seal may also be perforated so as to allow the user to access the edge of the lid. In one exemplary embodiment, a piece of adhesive (not shown) may be applied over the perforated portion of the tamper-evident seal to ensure that the tamper-evident seal is not inadvertently broken prior to initial use. As shown in FIG. 9, the tamper-evident seal 126 is an integral with the packaging material. In another exemplary embodiment, the tamper-evident seal is similar to the tamper-evident seal as depicted in FIG. 9 with the exception that the tamper-evident seal is not integral with the packaging material. Rather, the tamper-evident seal is a separate piece of material that may be adhered to the lid and the packaging material by adhesives, heat seal, or induction seal. As those skilled in the art will appreciate, the embodiments of the tamper-evident seal, as described above, may be applied to the various fitment embodiments described herein.

Figure 10:
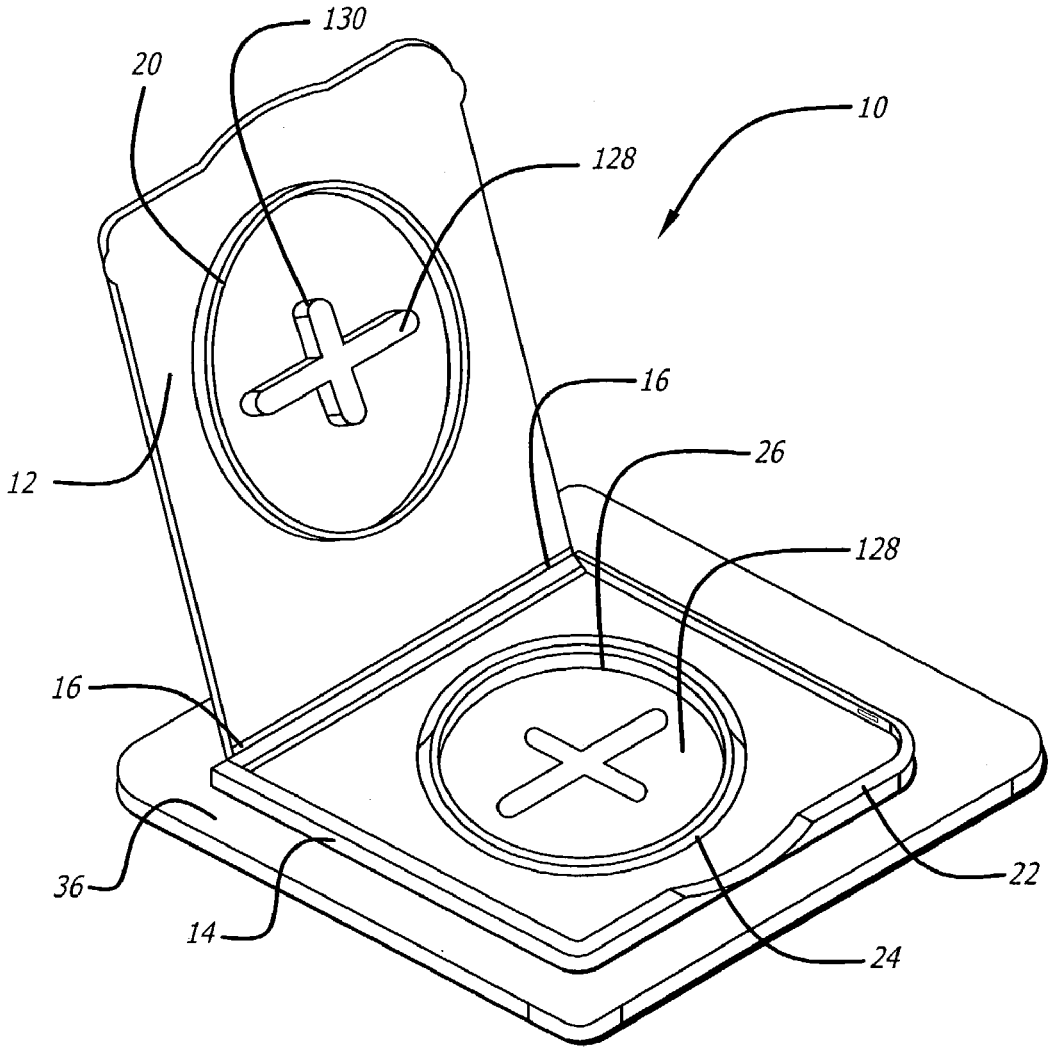
FIG. 10 is a perspective view of an exemplary fitment embodiment having a non-detachable tamper-evident seal removed from the opening of the fitment.

FIG. 10 illustrates another exemplary embodiment of a non-detachable tamper-evident seal 128. The tamper-evident seal 128 is a sheet of material that covers the opening 26 of the fitment base 14. The periphery of the tamper-evident seal may be coupled to the base 14 of the fitment by heat sealing or induction sealing. The lid 12 of the fitment is provided with a protuberance 130 that extends from the surface of the lid 12 and contacts the tamper-evident seal 128 when the lid 12 is closed. Accordingly, the tamper-evident seal may also be coupled to the protuberance by heat sealing or induction sealing. In use, when the lid 12 is opened, the portion of the tamper-evident seal 128 that is adhered to the protuberance 130 is torn away from the opening of the base thereby permitting access to the contents of the package. Additionally, the portion of the tamper-evident seal 128 remains adhered to the protuberance 130 thereby minimizing the potential choking hazard of a detachable tamper-evident seal.

As those skilled in the art will appreciate, the protuberance. 130 may be shaped and sized according to the desired application. For example, the protuberance may be shaped as an ellipse, oval, square, rectangle, triangle, pentagon, hexagon, octagon, polygon, starshape, dumbbell, or any other shapes. In one exemplary embodiment, the tamper-evident seal may be scribed to facilitate the tearing of the tamper-evident seal when the lid is initially opened.

Figures 11, 12, 13:
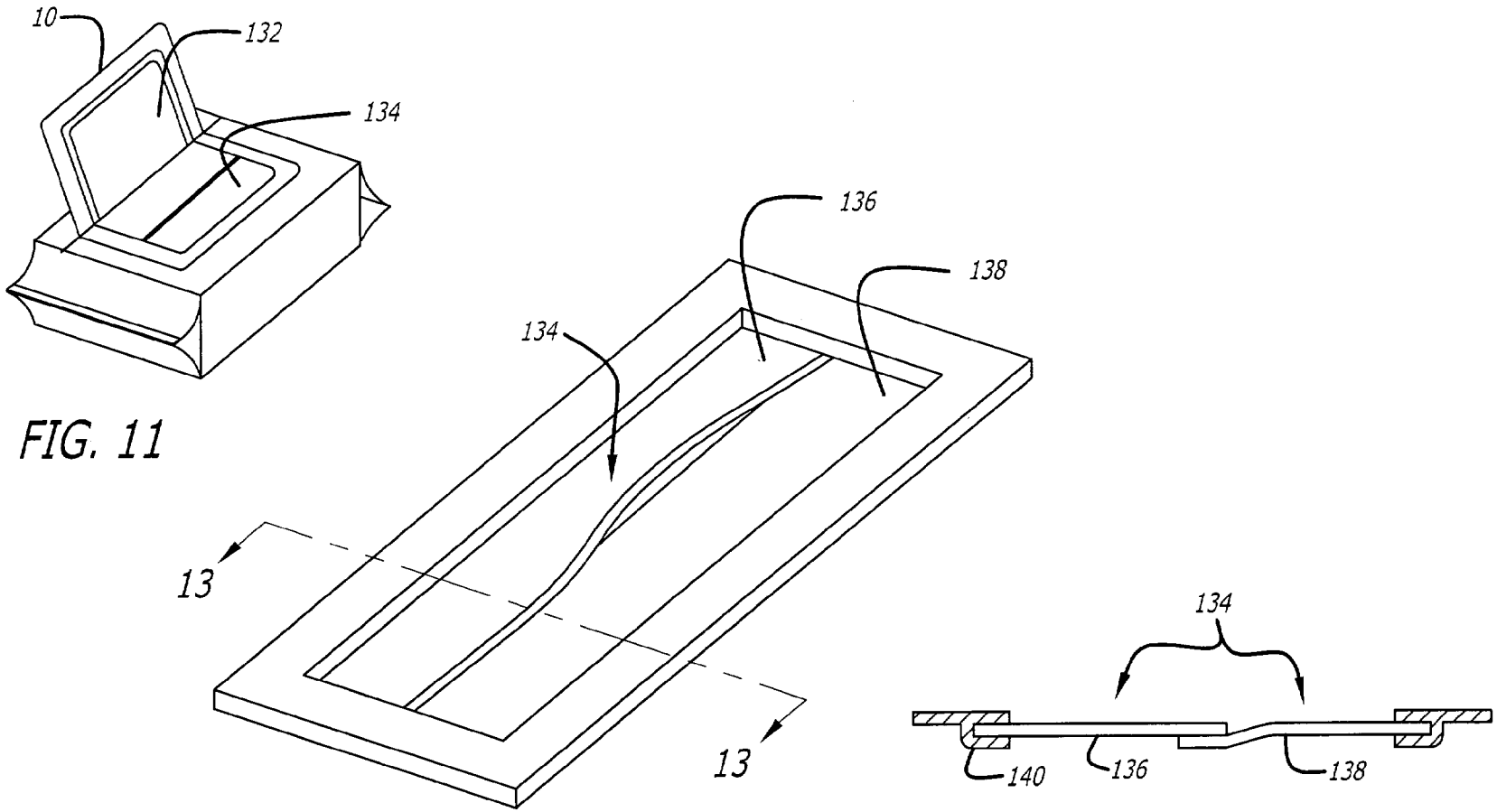
FIG. 11 is a perspective of an exemplary package having a fitment with a baffle.
FIG. 12 is exploded perspective view of FIG. 11.
FIG. 13 is a cross-sectional view of an exemplary embodiment of a baffle that spans an opening of an exemplary fitment.

FIGS. 11–13 illustrates another exemplary embodiment of a fitment 10 having a baffle 134. The baffle 134 is composed of overlapping flaps 136,138 that are self-biased in a closed position. According to one exemplary embodiment, the baffle 134 is made of a resilient flexible material such as, but not limited to, silicon-based polymer. As those skilled in the art will appreciate, other resilient flexible materials may be utilized. In one exemplary embodiment, the baffle may be heat sealed or induction sealed to the base of the fitment. In an alternate embodiment, the fitment base 14 is provided with flanges 140 that are sized to secure the baffle 134 to the fitment base 14.

In use, the lid 12 of the fitment 10 is opened to expose the baffle 134. The overlapping flaps 136,138 may be separated by depressing on the surface of the flaps to access a fluid-containing sheet (not shown). As the sheet is pulled through the flaps 136,138, the fluid contained in the sheets may be deposited on the edges of the flaps 136,138. The flaps then return to a closed position to seal the package. Additionally, the, surface tension of the deposited fluid on the edges of the overlapping flaps then creates a seal. Accordingly, the baffle 134 provides an additional sealing mechanism to ensure that the package remains airtight in the event that the lid 12 on the fitment 10 is not closed.

Figure 14:
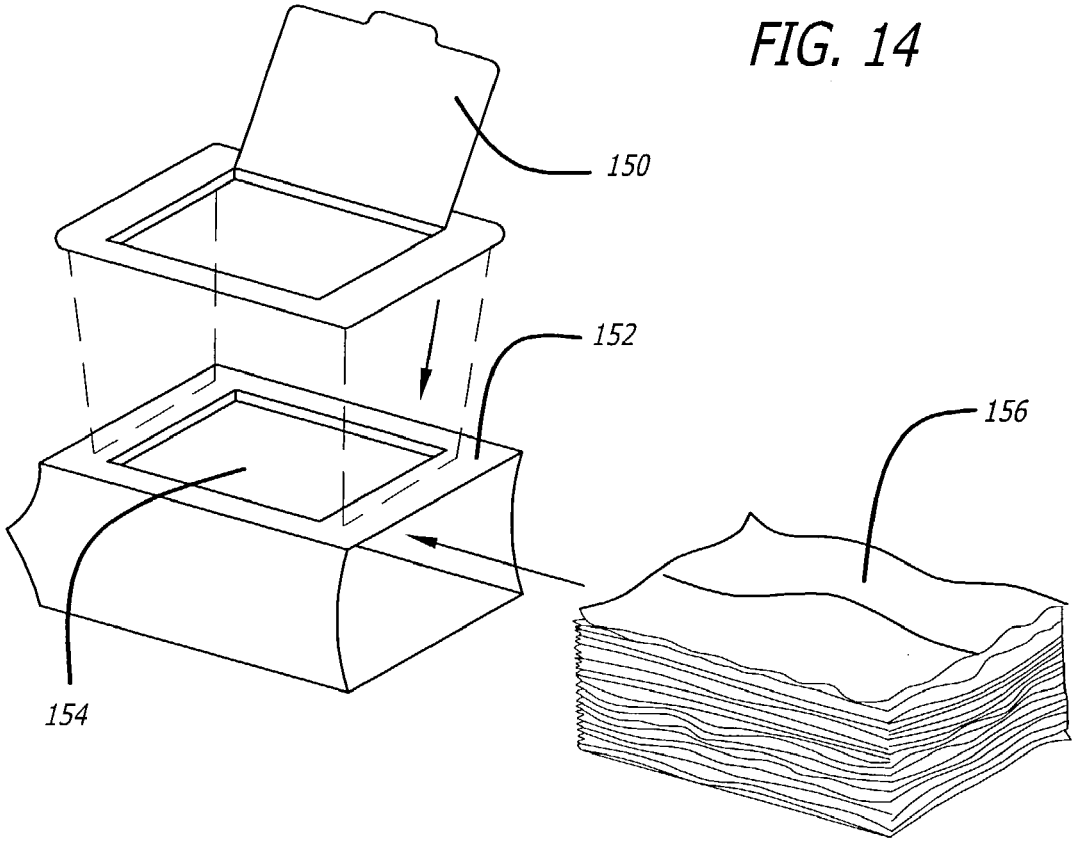
FIG. 14 is a perspective view of an exemplary embodiment of a fitment attached to a package.
Figure 15:
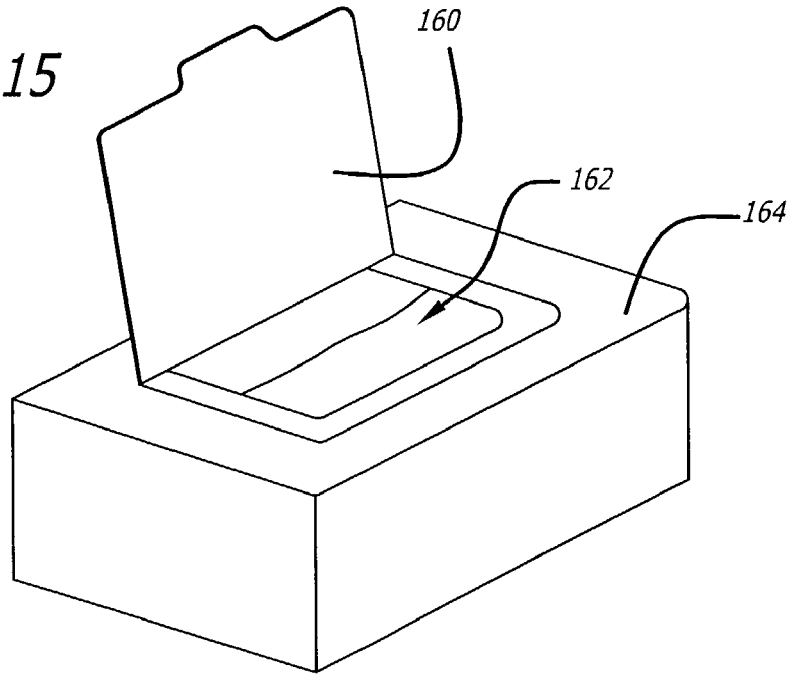
FIG. 15 is a perspective view of another exemplary embodiment of a fitment attached to a package.

FIGS. 14–15 illustrate the various fitment embodiments attached to various types of packages. As shown in FIG. 14, a fitment 150 is coupled to a flexible bag 152. The fitment is placed over the opening 154 of the flexible bag and welded in place. A stack of fluid-containing sheets 156 may be placed within the flexible bag and sealed to form a completed package. Alternatively, as shown in FIG. 15, the opening 162 of the package is centered over the fitment 160. That is, the fitment 160 is welded from the inside of the flexible bag (not shown). Accordingly, the top of the fitment is flush with the surface of the package. As shown in FIG. 15, the flexible bag is then placed within a box 164 to form a completed package.

According to one exemplary embodiment, the fitment material and the package material are matched for optimum sealing interface. For example, the fitment may be made from rigid polyethylene and the package material is made of a polyethylene layer. Alternatively, the package material may be composed of a plurality of layers of material. Accordingly, the layer of the package that contacts the fitment may be matched to the material of the fitment. For example, the package material may be composed of outer polypropylene layer with an inner polyethylene layer. In one exemplary embodiment, a fitment made of polypropylene may be welded to the outer layer of the package. In another exemplary embodiment, a fitment made of polyethylene may be welded to the inner layer of the package.

A hermetic package having a fitment, as described above, may be manufactured by according to various methods. According to one exemplary method, a substantially airtight film is unwound and moved by a feeder wherein the inner surface of the bag is face upwards. A hole is then punched into the unwound material. A fitment is then placed within the hole and welded to the film. According to another exemplary method, a tamper-evident seal may then be applied over the opening of the fitment. A stack of fluid-containing wipes is then placed on the film and the fitment. In another exemplary method, a stack of non-moistened wipes may be placed on the film and subsequently impregnated with a fluid. The film is then wrapped around the stack of fluid-containing wipes by a bag-making machine. The bag is then heat or induction sealed to form a completed package. The web of packages may then be separated into individual packages. In another exemplary method, the completed package may then be placed into and adhesively coupled a box having an opening sized to receive the fitment of the completed package.

Figure 16:
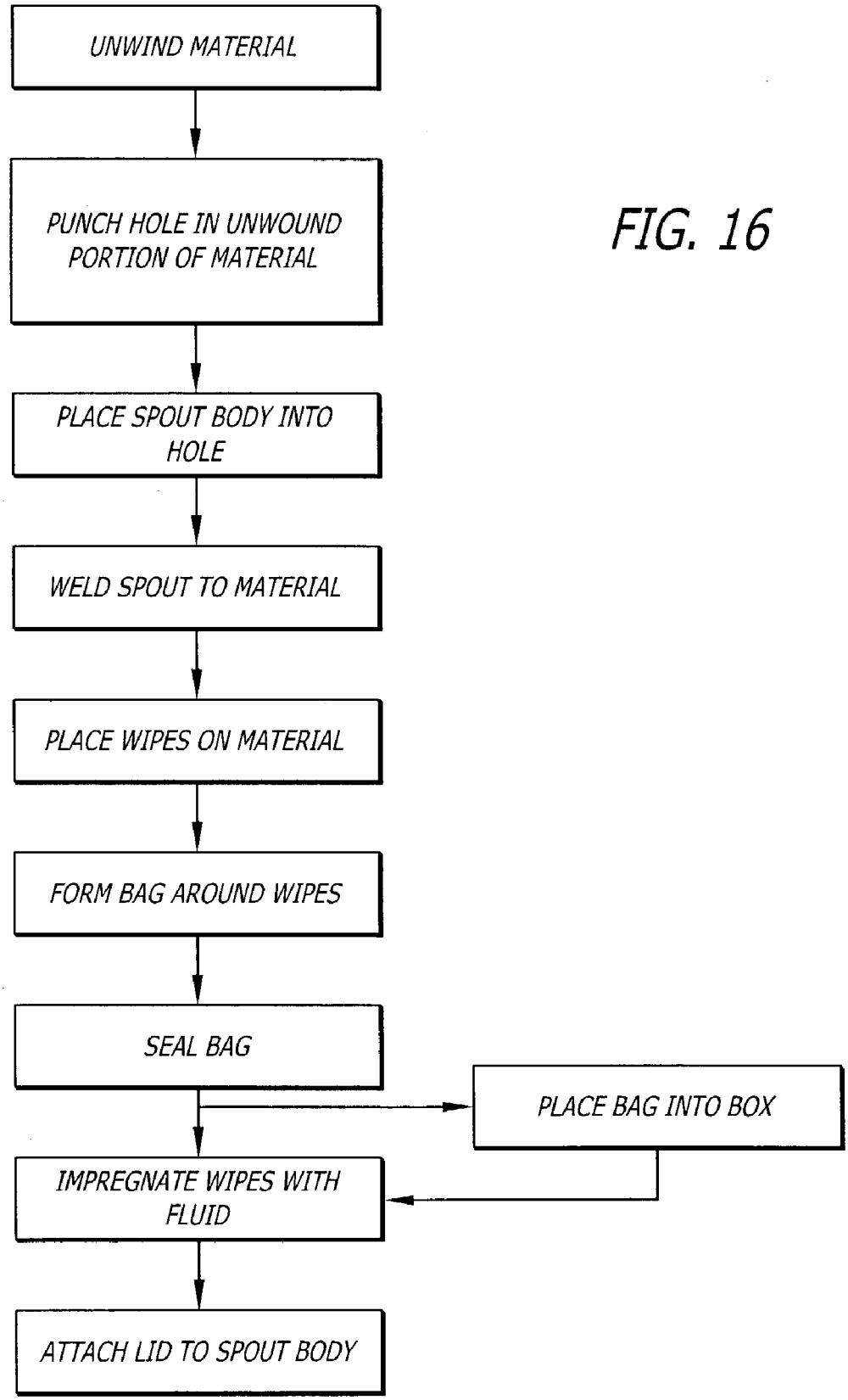
FIG. 16 is a schematic diagram showing an exemplary method of manufacturing a package having a 2-piece fitment.

According to another exemplary method, a hermetic package may be formed having a two-piece fitment. The steps are schematically show in FIG. 16. First, a substantially airtight film is unwound and moved by a feeder wherein the inner surface of the bag is face upwards. A hole is then punched into the unwound material. The spout body is then placed within the hole and welded to the film. A dry stack of wipes or tissues is then placed on the film and the spout. In an alternate method, a stack of fluid-impregnated wipes or tissues may placed on the film and the spout. The film is then wrapped around the stack of fluid-containing wipes by a bag-making machine. The bag is then heat or induction sealed to form a completed package. In another exemplary method, the completed bag may then be placed into a box having an opening sized to receive the spout. Prior to placing the lid on the spout, the dry wipes or tissues may then impregnated with a fluid. In those methods wherein the completed package is placed within the box, the attachment of the lid onto the spout also secures the box to the package. That is, the lid body may have a recess or flange that is adapted to capture the edge of the box when the lid body is coupled to the spout body.

In closing, it is to be understood that the exemplary embodiments disclosed herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not intended to be a limitation thereof.

What is claimed is:

1. A fitment attachable to a package, comprising:

a base having a collar that defines an opening, the collar having a recessed groove, the recessed groove having opposing inner and outer walls and a base therebetween;

a lid having a first face and a second face coupled to the base; and a sealing member comprising at least one wall extending from the second face of the lid, the at least one wall having a circular curved structure having a concave face and convex face opposing the concave face, wherein the convex face is sized such that in a closed orientation, the convex face curves outwardly so as to contact each of the base and the inner wall of the recessed groove, to, in turn, form a substantially airtight seal for the package; wherein the convex face and the concave face approach each other so as to define a taper in the at least on wall, to, in turn, facilitate the flexing of the at least one wall.

2. The fitment of claim 1 wherein the sealing member is annular.

3. The fitment of claim 1 wherein the lid and the base are integral.

4. The fitment of claim 1 further comprising at least one protuberance extending from the second face of the lid; and a non-detachable tamper-evident material is provided over the opening, wherein the non-detachable tamper-evident material is adhered to the collar and to the least one protuberance on the second face of the lid in a closed configuration, whereupon positioning of the lid into an open configuration separates a portion of the non-detachable tamper-evident material adhered to the protuberance on the second face of the lid, thereby evidencing the opening of the fitment.

5. The fitment of claim 1 wherein at least one of the opposed walls includes an outward indentation proximate the intersection of the outer wall and the base, the indentation configured to receive a distal end of the at least one wall of the sealing member therein to, in turn, further secure the distal end of the at least one wall therein.

6. The fitment of claim 3 wherein the lid is hinged to the base.

7. The fitment of claim 4 wherein the protuberance comprises a pair of ridges positioned in a generally orthogonal orientation relative to each other, to, in turn, provide a substantially corresponding opening on the non-detachable tamper-evident material.

8. The fitment of claim 4 wherein the fitment is coupled to a flexible package such that the non-detachable tamper-evident material is formed from the flexible package.

9. The fitment of claim 1 wherein one of the lid and the base includes a projection and the other of the lid and the base includes a recess, wherein the projection and the recess are positioned so as to releasably matingly engage in a closed configuration.

10. The fitment of claim 1 wherein the base includes a perimeter, an upper portion and a lower portion, and a flange extending about the perimeter capable of attachment to a flexible package.

* * * * *